US008543021B2

(12) United States Patent
Sakata et al.

(10) Patent No.: US 8,543,021 B2
(45) Date of Patent: Sep. 24, 2013

(54) IMAGE FORMING APPARATUS

(75) Inventors: Shiro Sakata, Numazu (JP); Yusuke Saito, Susono (JP); Mitsunari Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 13/169,212

(22) Filed: Jun. 27, 2011

(65) Prior Publication Data

US 2012/0002989 A1 Jan. 5, 2012

(30) Foreign Application Priority Data

Jun. 30, 2010 (JP) ..... 2010-149375

(51) Int. Cl.
*G03G 15/02* (2006.01)
*G03G 15/00* (2006.01)

(52) U.S. Cl.
USPC ..... 399/48; 399/50

(58) Field of Classification Search
USPC ..... 399/48, 50
See application file for complete search history.

(56) References Cited

U.S. PATENT DOCUMENTS

| | | | | |
|---|---|---|---|---|
| 4,896,192 | A * | 1/1990 | Kinoshita | |
| 6,744,994 | B2 * | 6/2004 | Yoshikawa et al. | |
| 2003/0235419 | A1 * | 12/2003 | Ota | 399/50 |
| 2011/0110677 | A1 * | 5/2011 | Uehara | 399/50 |
| 2011/0217064 | A1 | 9/2011 | Sakata et al. | |

FOREIGN PATENT DOCUMENTS

| | | | |
|---|---|---|---|
| JP | 06-003932 | A | 1/1994 |
| JP | 2003-295540 | A | 10/2003 |

* cited by examiner

*Primary Examiner* — Susan Lee
(74) *Attorney, Agent, or Firm* — Fitzpatrick, Cella, Harper & Scinto

(57) ABSTRACT

The image forming apparatus calculates a surface voltage of an image bearing member based on a first charge start voltage, which is obtained when a first voltage application section applies a first DC voltage to a charge section, and a second charge start voltage, which is obtained when a second voltage application section applies a second DC voltage to the charge section. This allows a high-quality image to be formed irrespective of a change in circumstance or drum layer thickness.

6 Claims, 14 Drawing Sheets

| FIG. 6A |
| --- |
| FIG. 6B |

IMAGE FORMING APPARATUS

BACKGROUND OF THE INVENTION

1. Field of the Invention

The present invention relates to an image forming apparatus including a charge bias application circuit for charging an image bearing member.

2. Description of the Related Art

Description is given below by taking a printer as an example of the image forming apparatus. Conventionally, the printer has a configuration as illustrated in FIG. 10A. A rotating polygon mirror 103 is rotated by a scanner motor 104. A laser beam 205 is emitted from a laser light source 207, and scans a photosensitive drum 201 serving as an image bearing member. A charge roller 202 uniformly charges the photosensitive drum 201. A developing roller (also referred to as "developing sleeve") 203 develops an electrostatic latent image formed on the photosensitive drum 201 with toner. A transfer roller 204 transfers a toner image developed by the developing sleeve 203 onto fed paper. Fixing rollers 109 fuse and fix the toner image transferred onto the paper with heat. A cassette paper feeding roller 110 feeds the paper from a cassette to send out the paper to a conveyance path. Pairs of conveyance rollers 114 and 115 convey the paper fed from the cassette to a transfer position formed between the photosensitive drum 201 and the transfer roller 204.

FIG. 10B is a block diagram illustrating a circuit configuration of a control system for controlling the above-mentioned mechanical parts. Referring to FIG. 10B, a printer controller 501 loads image code data sent from an external device (not shown), such as a host computer, as bit data necessary for printing to be performed in the printer, and at the same time, reads and displays printer internal information. An engine control part 502 controls each part of the printer in response to an instruction from the printer controller 501, and at the same time, notifies the printer controller 501 of the printer internal information. A charge bias application circuit 206 controls, in response to an instruction from the engine control part 502, an output of a charge bias in a charge step among charge, development, and transfer steps. A laser driving circuit 505 controls ON/OFF of the laser light source 207 in response to an instruction from the engine control part 502.

FIG. 11 illustrates a schematic configuration of a charge bias application circuit part 601 for applying the charge bias to the charge roller 202 serving as a charge material for charging the photosensitive drum 201 serving as the image bearing member. The charge bias application circuit part 601 is an example of the above-mentioned charge bias application circuit 206. A voltage setting circuit part 602 is capable of changing a setting value according to a PWM signal. The PWM signal is input according to a target value of the charge bias to be output. A transformer drive circuit part 603 and a high voltage transformer part 604 are further provided. A feedback circuit part 605 detects a voltage value applied to the charge member/charge material (load) through a resistor R81, and transmits the voltage value to the voltage setting circuit part 602. In the subsequent control, a PWM signal (target value) is obtained so that the detected value is input, and a constant voltage is applied to the charge member/charge material (load). Through the control with such a configuration, a constant voltage can be applied to the charge member/charge material (load). For example, Japanese Patent Application Laid-Open No. H06-003932 discloses a high voltage power source device that employs such a technology of charge bias application.

However, a voltage for starting charging between the charge material (charge roller 202) and the charge member (photosensitive drum 201) changes depending on ambient temperature, a drum layer thickness, or the like. Hence, variations in voltage of the photosensitive drum 201 occur when the predetermined voltage is merely applied (FIG. 12A). FIG. 12A is a graph showing a relationship between an application voltage (V) applied to the photosensitive drum 201 and a drum voltage (V) of the photosensitive drum 201. In FIG. 12A, a circumstance H/H, a circumstance N/N, and a circumstance L/L represent that the state of the circumstance is high temperature and high humidity, normal temperature and normal humidity, and low temperature and low humidity, respectively. When an application voltage (Vout) is set constant, it is found from FIG. 12A that variations in voltage of the photosensitive drum 201 occur due to the difference in drum layer thickness or the difference in circumstance. From the fact that the sensitivity of the photosensitive drum 201 also differs due to the circumstance or the drum layer thickness, in a case where a laser beam with a constant light amount is emitted to the photosensitive drum 201, there also occur variations in voltage of the electrostatic latent image on the photosensitive drum after the laser illumination (FIG. 12B). FIG. 12B is a graph showing a relationship between a laser illumination light amount and a voltage (VL) of the photosensitive drum after the laser illumination. When the laser illumination light amount is set constant (for example, vertical chain line of FIG. 12B), it is found from FIG. 12B that variations in voltage (VL) of the photosensitive drum 201 after the laser illumination occur due to the drum layer thickness (in FIG. 12B, for example, −128 V in a case of thicker drum layer and −197 V in a case of thinner drum layer).

Further, as a characteristic of the photosensitive drum 201, drum memory adversely occurs through the laser illumination. The drum memory is a phenomenon that, though the drum voltage of the photosensitive drum 201 is supposed to be 0 V after a voltage remaining on the surface thereof is eliminated, the drum voltage becomes negative, resulting in variations in drum voltage after the laser illumination. In order to reduce the variations, the following measure has been taken. That is, a memory is provided to a process cartridge including the photosensitive drum 201, and, for example, a bias value according to the sensitivity and usage of the photosensitive drum 201 is stored in the memory. Then, based on the information, the charge bias, the developing bias, and the laser light amount corresponding to the sensitivity and the usage are corrected, to thereby reduce the variations in voltage. However, the control based on the information of the cartridge memory is predictive control. Therefore, as the printing speed or the cartridge toner amount is increased, the system using the predictive control based on the information of the cartridge memory has a limitation in the correction of the variations in voltages between Vd−Vdc and between Vdc−VL as shown in FIGS. 13A and 13B. In FIGS. 13A and 13B, Vd represents a drum voltage after the charging by the charge roller, Vdc represents a developing bias, and VL represents a drum voltage after the laser illumination.

SUMMARY OF THE INVENTION

The purpose of the present invention is to provide an image forming apparatus capable of forming a high-quality image irrespective of a change in circumstance or drum layer thickness.

Another purpose of the present invention is to provide an image forming apparatus, including an image bearing member; a first voltage application section for applying a first DC voltage to a charge section for charging the image bearing member, a second voltage application section for applying a second DC voltage, which has a polarity reverse to a polarity of the first DC voltage, to the charge section for charging the image bearing member, and a calculation section for calculating a surface voltage of the image bearing member based on a first charge start voltage between the charge section and the image bearing member, which is obtained when the first voltage application section applies the first DC voltage to the charge section, and a second charge start voltage between the charge section and the image bearing member, which is obtained when the second voltage application section applies the second DC voltage to the charge section.

Further features of the present invention will become apparent from the following description of exemplary embodiments with reference to the attached drawings.

DESCRIPTION OF THE EMBODIMENTS

Hereinbelow, configurations and operations according to the present invention are described. Note that, embodiments described below are merely exemplary, and hence the technical scope of the present invention is not limited to the embodiments. Hereinbelow, referring to the attached drawings, modes for carrying out the present invention are described in detail by way of the embodiments.

First, a first embodiment of the present invention is described.

Configuration of Image Forming Apparatus

Figure 1:
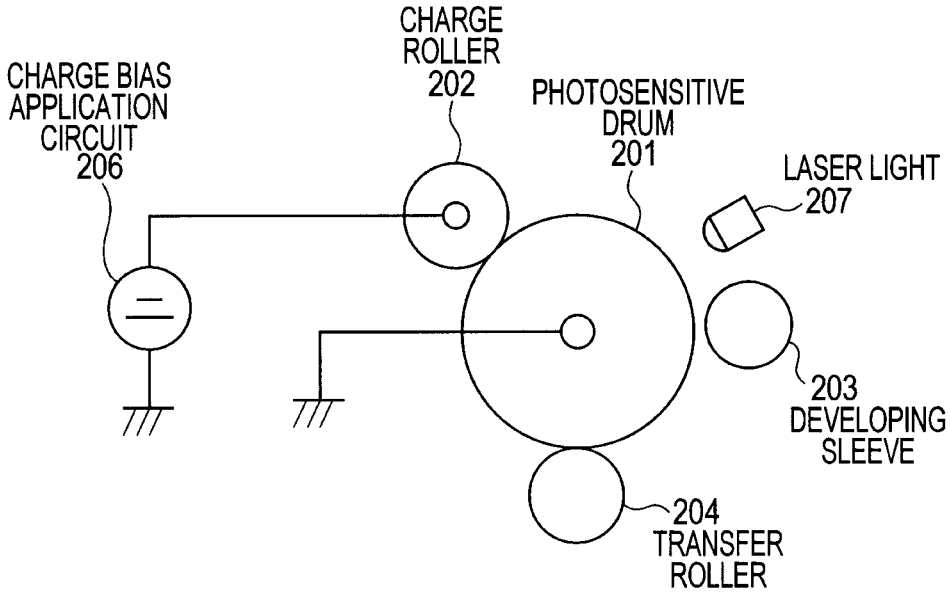
FIG. 1 is a schematic diagram illustrating an image forming part of an image forming apparatus according to a first embodiment of the present invention.
Figure 10A:
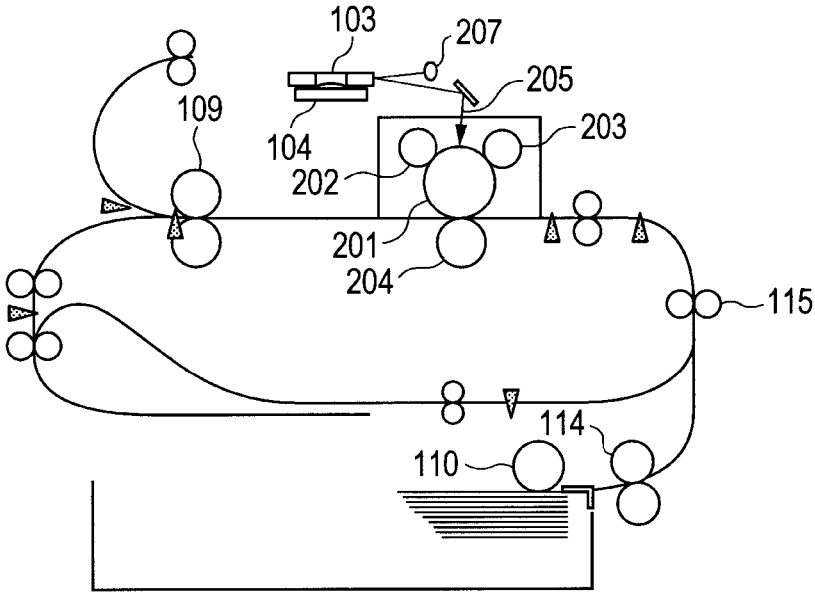
FIG. 10A is a configuration diagram illustrating an image forming apparatus according to the embodiments of the present invention and a conventional example.
Figure 10B:
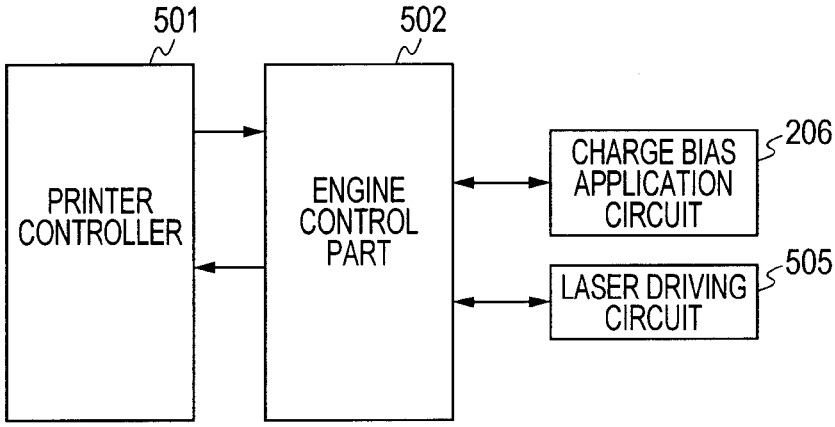
FIG. 10B is a block diagram illustrating a circuit configuration of a control system.
Figure 11:
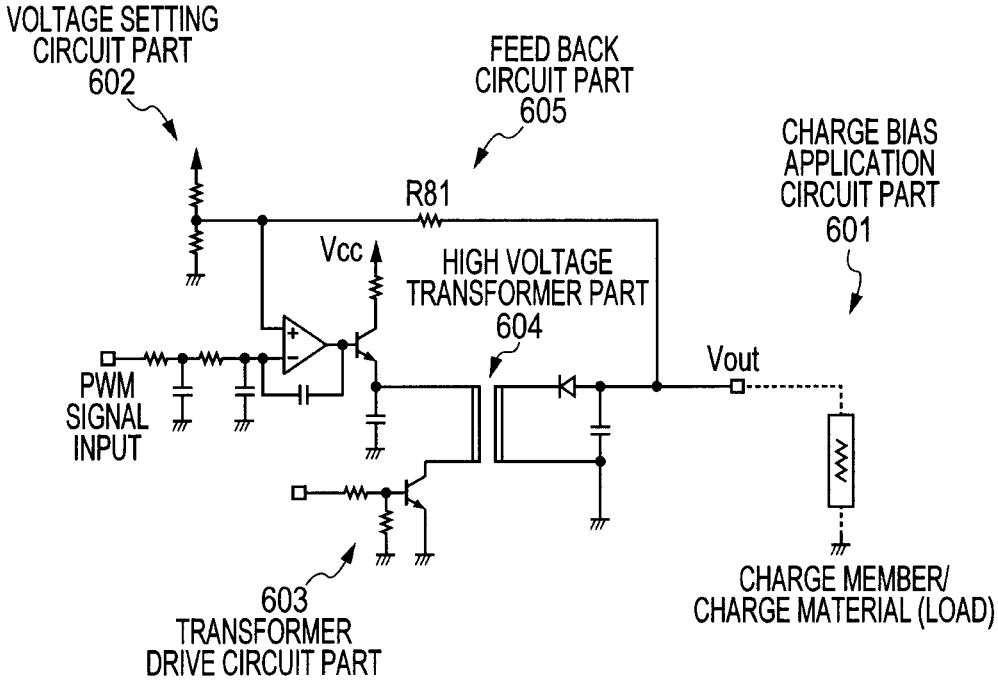
FIG. 11 is a diagram illustrating a charge bias application circuit part of the image forming apparatus according to the conventional example.
Figure 12A:
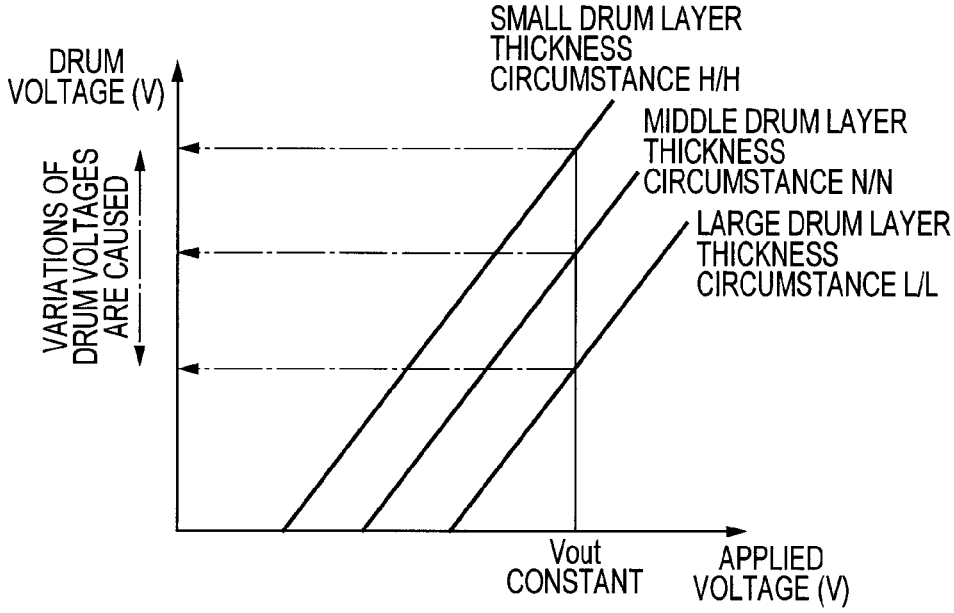
FIG. 12A is a graph showing a relationship between an application voltage and a drum voltage in a photosensitive drum according to the conventional example.
Figure 12B:
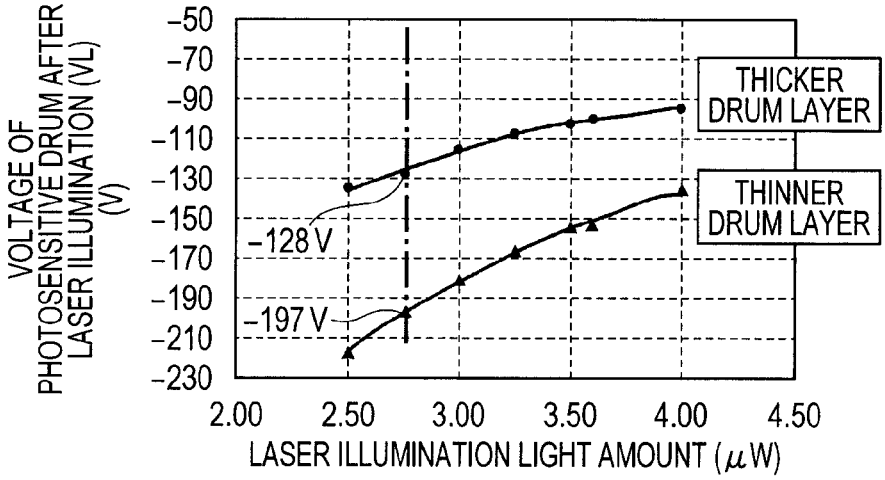
FIG. 12B is a graph showing a relationship between a laser illumination light amount and the drum voltage.
Figure 13A:
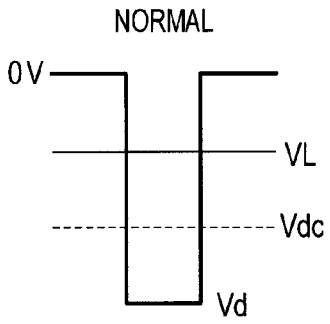
FIGS. 13A and 13B are graphs showing drum voltages of the photosensitive drum after laser illumination according to the conventional example.
Figure 13B:
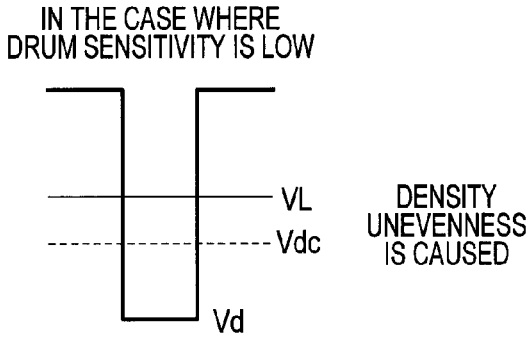

FIG. 1 is a schematic diagram illustrating an image forming part of an image forming apparatus according to this embodiment. The image forming apparatus includes a photosensitive drum 201, a charge roller 202 for uniformly charging the photosensitive drum 201, a developing sleeve (developing material) 203 for developing an electrostatic latent image, a transfer roller 204, a charge bias application circuit 206 serving as a voltage application circuit, and a laser light source 207. The charge bias application circuit 206 applies an alternative current bias voltage (hereinafter, referred to as "AC bias") to eliminate the voltage remaining on the photosensitive drum 201, and then a series of control is started. Note that, the image forming apparatus of this embodiment includes the same control system described above with reference to FIG. 10B.

Figure 2A:
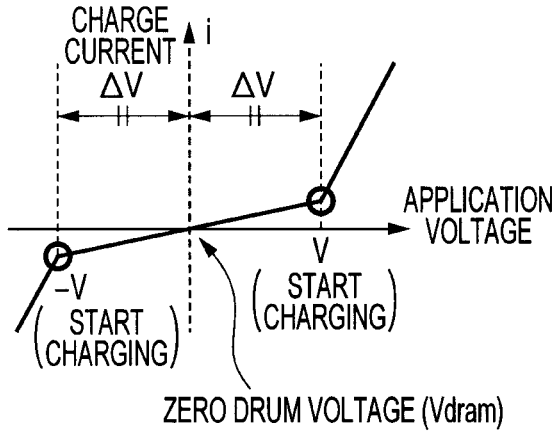
FIG. 2A is a graph showing a drum characteristic according to the first embodiment.
Figure 2B:
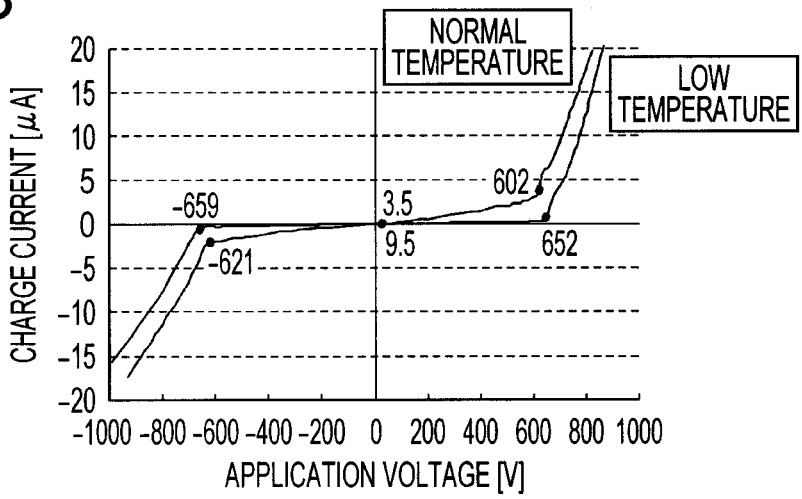
FIGS. 2B and 2C are graphs showing results of the drum characteristic.
Figure 2C:
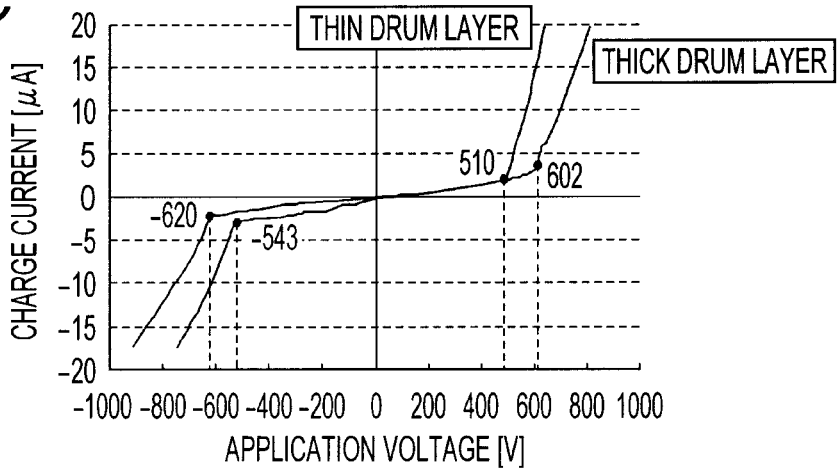

As a charge characteristic of the photosensitive drum 201, a voltage difference necessary for the charging differs due to a difference in circumstance or a difference in drum layer thickness. However, as shown in FIG. 2A, there is such a characteristic that, under a certain condition of the photosensitive drum 201, the voltage difference necessary to start the charging has a symmetric relationship between the positive voltage and the negative voltage (hereinafter, referred to as "positive-negative symmetry") with respect to a surface voltage (zero drum voltage) of the photosensitive drum 201. This characteristic is the same as the charge characteristic in a gap (plane to plane). FIGS. 2B and 2C show results of the characteristic of the photosensitive drum 201 obtained through actual measurement. FIG. 2B shows a characteristic based on the difference in circumstance, while FIG. 2C shows a characteristic based on the difference in drum layer thickness. The two pieces of data each indicate the positive-negative symmetry. Focusing on this characteristic, the image forming apparatus of this embodiment has a feature of detecting the surface voltage of the photosensitive drum 201 and the voltage difference necessary for the charging by the photosensitive drum 201, and setting high voltages (charge bias and developing bias) and a laser illumination light amount based on the detection results.

Configuration of Charge Bias Application Circuit

Figure 3:
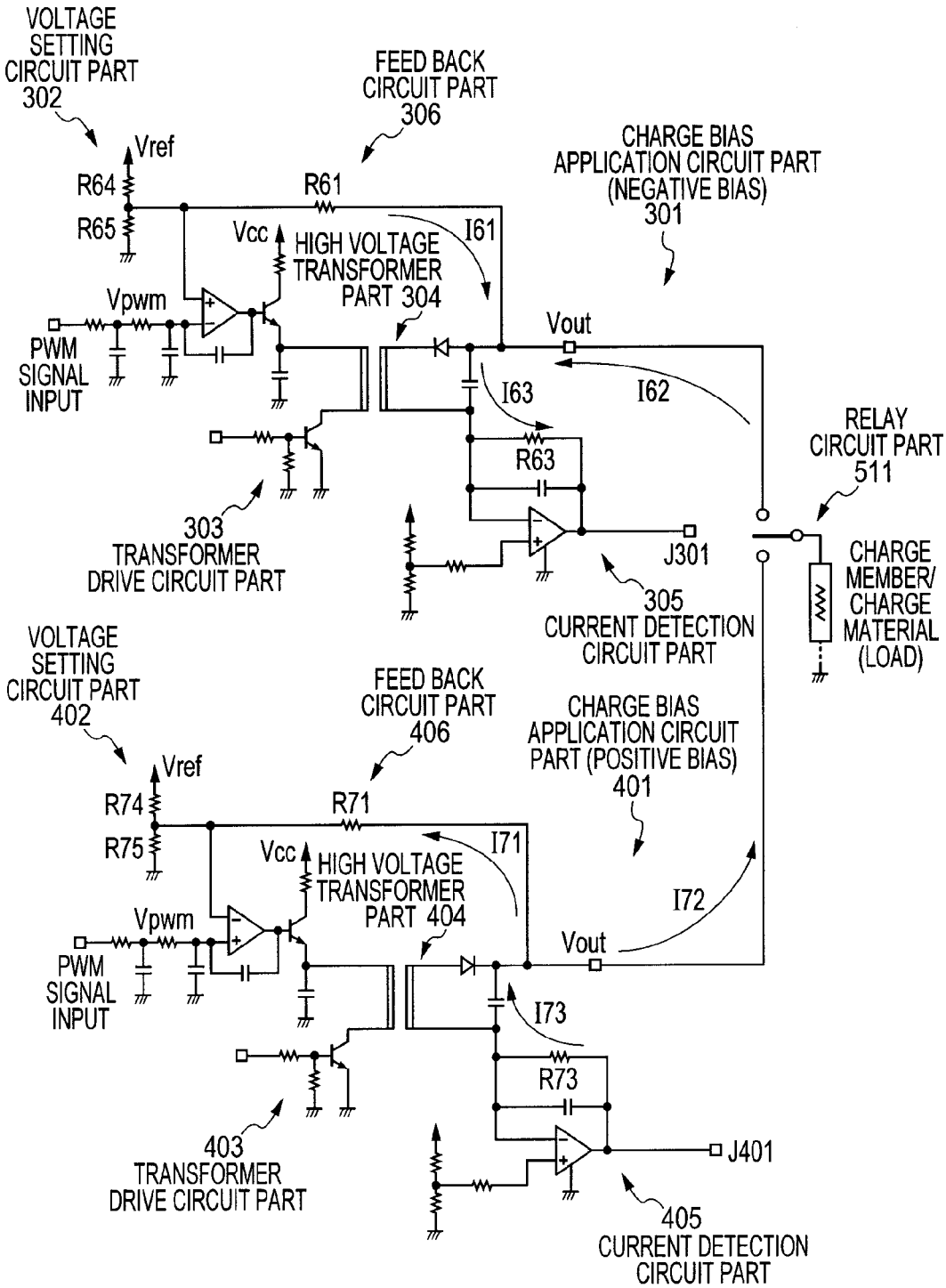
FIG. 3 is a diagram illustrating a charge bias application circuit part according to the first embodiment.

FIG. 3 illustrates, in the upper part thereof, a schematic configuration of a charge bias application circuit 301 for a negative bias according to this embodiment. Note that, the charge bias application circuit 301 and a charge bias application circuit 401 described later constitute the above-mentioned charge bias application circuit 206. A voltage setting circuit part 302 is capable of changing a bias value to be output according to a PWM signal. The charge bias application circuit 301A further includes a transformer drive circuit part 303 and a high voltage transformer part 304. A feedback circuit part 306 is a circuit for monitoring an output voltage through a resistor R61, the feedback circuit part 306 being provided so that an output voltage value is obtained according to the setting of the PWM signal. A current detection circuit part 305 detects, through a resistor R63, a current I63 obtained by adding a current I62 flowing through a charge member/charge material and a current I61 flowing from the feedback circuit part 306, and transmits the current I63 as an analog value from J301 to an engine control part 502 (see FIG. 10B).

The photosensitive drum 201 serving as an image bearing member is isolated from the charge roller 202 serving as the charge material until the charging starts between the photosensitive drum 201 and the charge roller 202. Accordingly, the current flowing through the resistor R63 is only the current I61 flowing from the feedback circuit part 306 until the charging starts. The current I61 is determined from Vpwm, which is set based on the PWM signal, Vref, R64, and R65, and has the following relationship.

$$I61=(V\text{ref}-V\text{pwm})/R64-V\text{pwm}/R65$$

Further, when the current I61 flows through the resistor R61, an output voltage Vout is set as follows.

$$V\text{out}=I61\times R61+V\text{pwm}\approx I61\times R61$$

Figure 4:
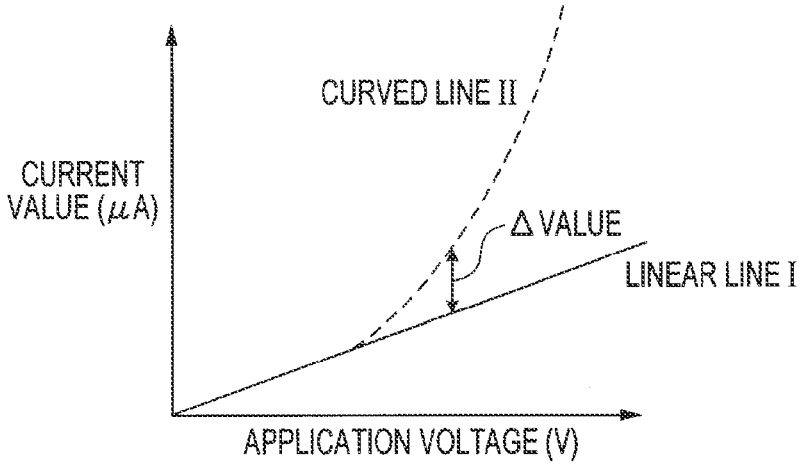
FIG. 4 is a schematic graph showing a V-I characteristic at the time of charge bias application according to the first embodiment.

FIG. 4 is a schematic graph showing transition of a current value (μA) with respect to the application voltage. As indicated by a linear line I, only the current I61 according to the PWM signal flows through the resistor R63 until the charging starts. However, when the charging starts between the photosensitive drum 201 and the charge roller 202, the current I63 obtained by adding the current I62 flowing through the photosensitive drum 201 and the current I61 flowing from the feedback circuit flows through the resistor R63. In other words, as indicated by a curved line II of FIG. 4, there is obtained a curved line having a branch point around the time when the charging starts. Thus, a charge current flowing through the photosensitive drum 201 can be calculated from a Δ value obtained by subtracting the linear line I from the curved line II. Then, a point at which the Δ value becomes a predetermined current value is determined as the application voltage at the time when the charging starts.

FIG. 3 further illustrates, in the lower part thereof, a schematic configuration of the charge bias application circuit 401 for a positive bias according to this embodiment. A voltage setting circuit part 402 is capable of changing a bias value according to a PWM signal. A transformer drive circuit part 403 and a high voltage transformer part 404 are further provided. A feedback circuit part 406 is a circuit for monitoring an output voltage through a resistor R71, the feedback circuit part 406 being provided so that an output voltage value is obtained according to the setting of the PWM signal. A current detection circuit part 405 detects, through a resistor R73, a current I73 obtained by adding a current I72 flowing through the charge member/charge material and a current I71 flowing through the feedback circuit part 406, and transmits the current I73 as an analog value from J401 to the engine control part 502. The method of calculating the voltage at the time when the charging starts is the same as that in the case of the charge bias application circuit 301 for the negative bias, and description thereof is therefore omitted herein.

A relay circuit part 511 switches between the above-mentioned positive and negative bias application circuits. Under the condition in which such two circuits are provided respectively for the positive bias and the negative bias, biases of a positive polarity and a negative polarity are applied with respect to the voltage of the photosensitive drum 201, and charge start voltages of both the polarities (detection voltage of the positive bias: V1 and detection voltage of the negative bias: V2) are detected. Then, a value obtained by halving a difference between the voltage value V1 and the voltage value V2 is set as a voltage difference ΔV that is necessary to start the charging by the photosensitive drum 201, and a central value between V1 and V2 is set as a zero drum voltage (Vdram) of the photosensitive drum 201. In the subsequent control, a bias to be applied to the photosensitive drum 201 serving as the charge member, and a bias to be applied to the developing sleeve 203 are set according to the setting values. Through the control described above, a predetermined relationship, that is, (voltage of the photosensitive drum 201)−(developing bias) (Vd−Vdc), can be obtained irrespective of the fluctuation in drum layer thickness, circumstance, or the like.

Figure 5:
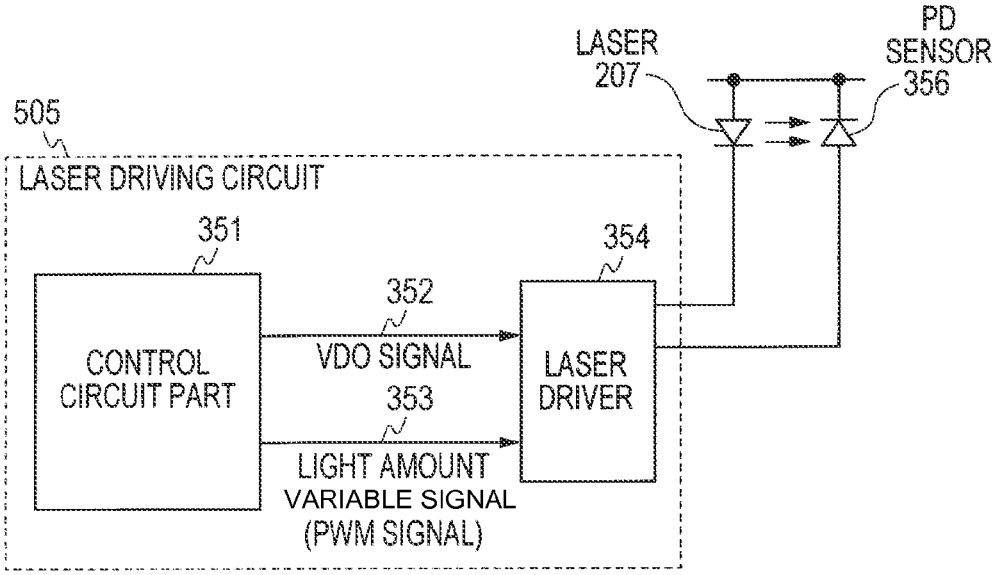
FIG. 5 is a configuration diagram illustrating a laser driving circuit according to the first embodiment.

Further, FIG. 5 illustrates a schematic configuration of a laser driving circuit 505 according to this embodiment. A laser driver 354 monitors an exposure amount of the laser light source 207 by using a PD sensor 356 to control an emission amount to be constant. A light amount variable signal (PWM signal) 353 is input from a control circuit part 351 to the laser driver 354, with the result that the light amount is variably set according to the light amount variable signal (PWM signal) 353. With this configuration, the light amount for illuminating the photosensitive drum 201 is variably set, and hence, when a drum voltage (VL) after the laser illumination is detected and its value differs from a predetermined value, the value of VL can be corrected by changing the laser light amount. Through the correction described above, a predetermined relationship, that is, (voltage of the photosensitive drum 201 after the laser illumination)−(developing bias) (VL−Vdc), can be obtained.

Charge Bias Control

Figures 6, 6A:
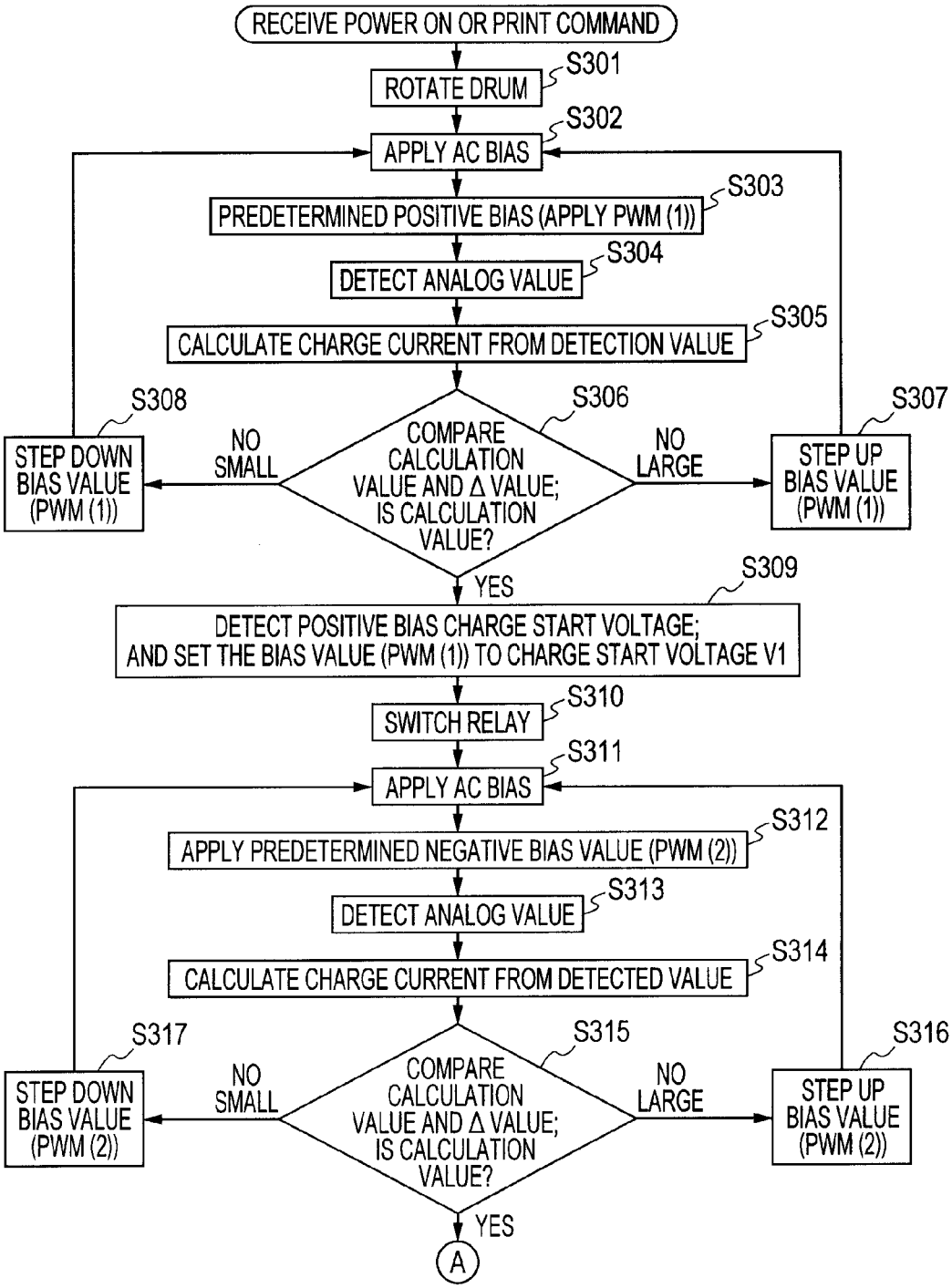
FIG. 6 is comprised of FIGS. 6A and 6B showing flowcharts illustrating charge bias control according to the first embodiment.
Figure 6B:
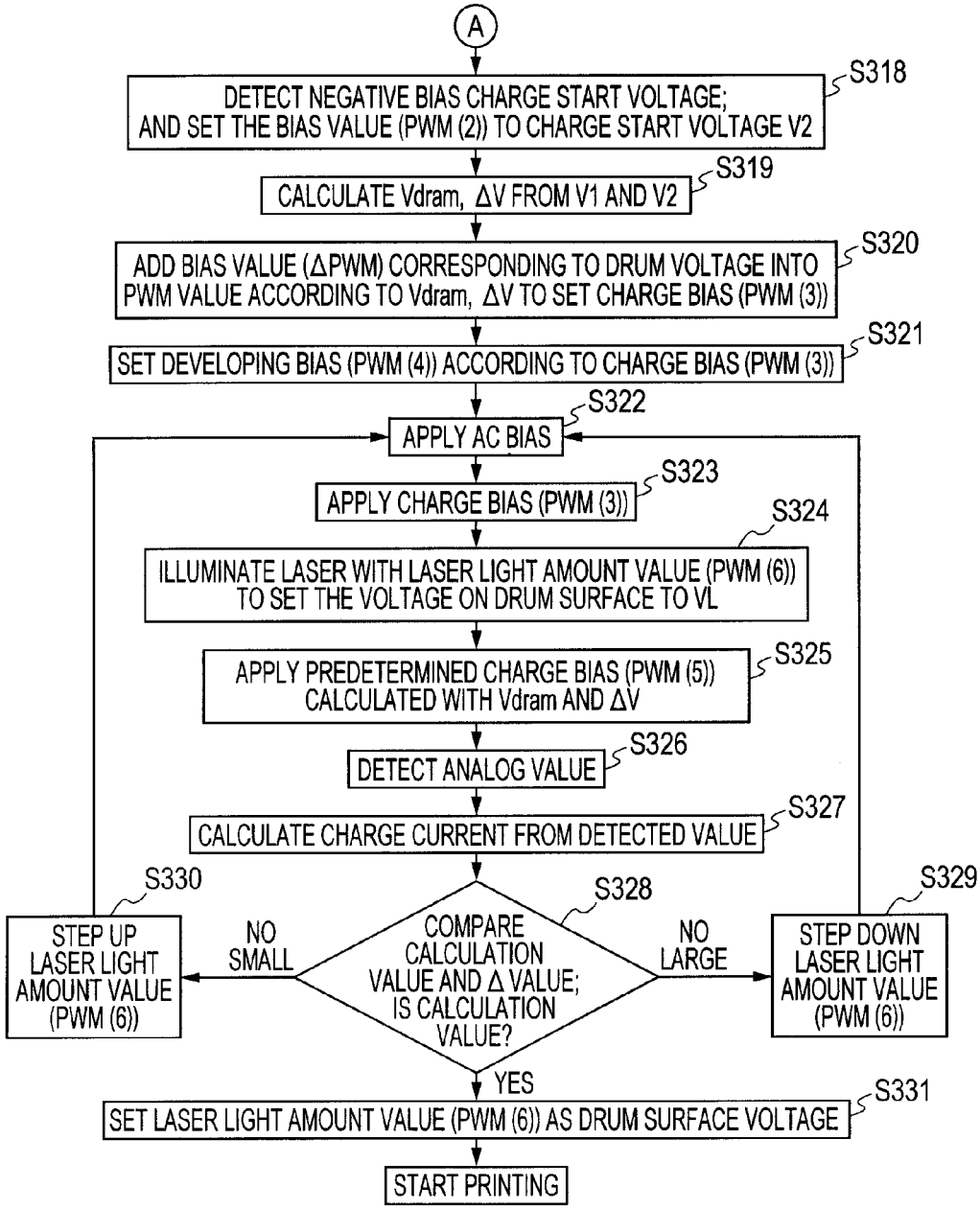

Next, referring to flowcharts of FIGS. 6A and 6B and voltage graphs of FIGS. 7A to 7D, the control of this embodiment is described. First, after the engine control part 502 is powered on or receives a print command, the engine control part 502 executes a print preparation operation while rotating the photosensitive drum 201 for a predetermined period of time (also referred to as "multiple initial rotation" or "initial rotation") (Step (hereinafter, referred to as "S") 301). Then, the charge bias application circuit 206 applies the AC bias to the photosensitive drum 201 to eliminate the remaining voltage (S302). After that, the charge bias application circuit 401 applies a predetermined positive bias (PWM(1)) (S303). Then, the engine control part 502 detects, by using the current detection circuit part 405, the current I73 obtained by summing the current I72 flowing through the photosensitive drum 201 and the current I71 flowing through the feedback circuit part 406, to thereby detect the analog value of J401 (S304). The engine control part 502 calculates the charge current from the detection value (S305), and compares the calculation value and the Δ value to determine whether or not the calculation value falls within a tolerance of the Δ value (S306). Specifically, the engine control part 502 determines whether or not the calculation value falls within a range between a lower limit of the Δ value and an upper limit of the Δ value. When the determination result shows that the calculation value is larger than the upper limit of the Δ value, the engine control part 502 determines that the charge start voltage is set to a lower value, and hence causes the charge bias application circuit 401 to step up the bias value (PWM(1)) (S307). On the other hand, when the determination result shows that the calculation value is smaller than the lower limit of the Δ value, the engine control part 502 determines that the charge start voltage is set to a higher value, and hence causes the charge bias application circuit 401 to step down the bias value (PWM(1)) (S308). Through this operation, the engine control part 502 determines that the positive side voltage of FIG. 2A can be detected when the calculation value falls within the tolerance of the Δ value, and sets the bias value (PWM(1)) at this time as the charge start voltage V1 of the positive bias (S309).

Figure 7A:
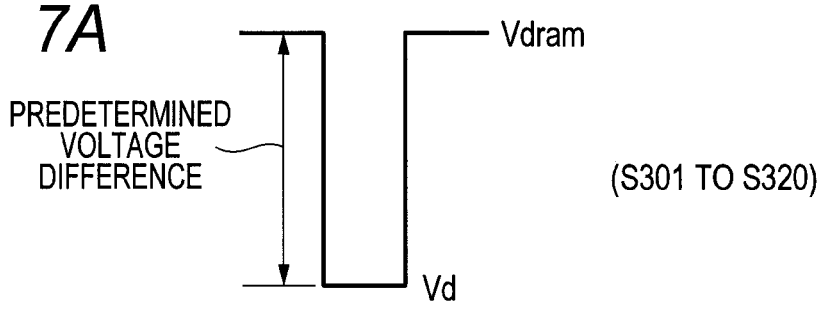
FIGS. 7A, 7B, 7C, and 7D are graphs showing voltages of a photosensitive drum obtained as a result of the charge bias control according to the first embodiment.
Figure 7B:
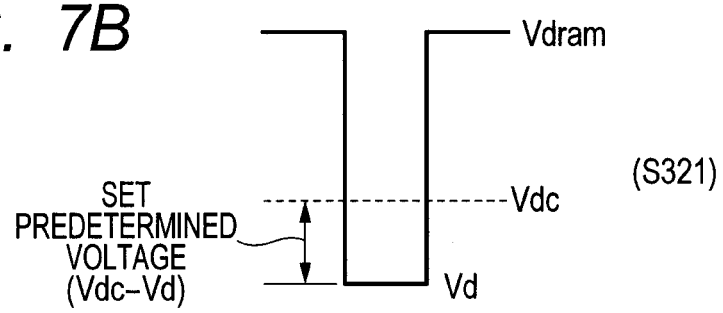

Subsequently, the engine control part 502 switches the relay by using the relay circuit part 511, to thereby switch from the positive bias application to the negative bias application (S310). After that, the charge bias application circuit 206 applies the AC bias to the photosensitive drum 201 to eliminate the remaining voltage (S311). Then, the charge bias application circuit 301 applies a predetermined negative bias (PWM(2)) (S312). Subsequently, the engine control part 502 detects, by using the current detection circuit part 305, the current I63 obtained by summing the current I62 flowing from the photosensitive drum 201 and the current I61 flowing from the feedback circuit part 306, to thereby detect the analog value of J301 (S313). The engine control part 502 calculates the charge current from the detection value (S314). Then, the engine control part 502 compares the calculation value and the Δ value to determine whether or not the calculation value falls within the tolerance of the Δ value (S315). When it is determined that the calculation value is larger than the upper limit of the Δ value, the engine control part 502 determines that the charge start voltage is set to a lower value, and hence causes the charge bias application circuit 301 to step up the bias value (PWM(2)) (S316). On the other hand, when it is determined that the calculation value is smaller than the lower limit of the Δ value, the engine control part 502 determines that the charge start voltage is set to a higher value, and hence causes the charge bias application circuit 301 to step down the bias value (PWM(2)) (S317). Through this operation, the engine control part 502 determines that the negative side voltage of FIG. 2A can be detected when the calculation value falls within the tolerance of the Δ value, and sets the bias value (PWM(2)) at this time as the charge start voltage V2 of the negative bias (S318). After that, the engine control part 502 calculates the value obtained by halving the difference between V1 and V2 as the voltage difference ΔV of FIG. 2A that is necessary to start the charging by the photosensitive drum 201, and calculates the central value between V1 (V of FIG. 2A) and V2 (−V of FIG. 2A) as the zero drum voltage (Vdram) of the drum (S319). The engine control part 502 adds a bias value (ΔPWM) corresponding to the drum voltage into the PWM value according to the calculated voltage difference ΔV and zero drum voltage (Vdram), to thereby set a charge bias (PWM(3)) to be output from the charge bias application circuit 206 (S320). The setting value is ΔV+Vdram+Vd, provided that Vd represents a voltage to be superposed onto the photosensitive drum 201. Through the setting described above, the voltage Vd becomes constant as shown in FIG. 7A. Subsequently, the engine control part 502 sets a developing bias (PWM(4)) according to the set bias (PWM(3)) of the charge bias application circuit 206 (S321). Through this sequence, the voltage between Vd−Vdc is controlled to be a predetermined value as shown in FIG. 7B.

Figure 7C:
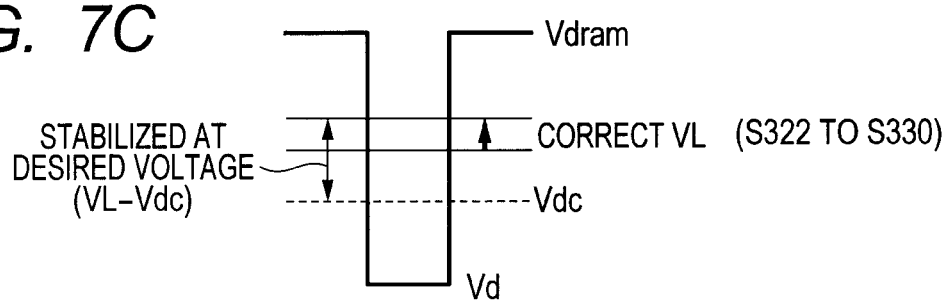
Figure 7D:
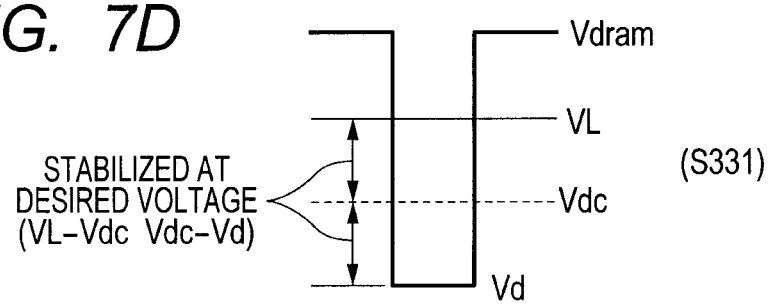

Subsequently, the process proceeds to a sequence of detecting the voltage VL after the laser illumination. First, the charge bias application circuit 206 applies the AC bias to the photosensitive drum 201 to eliminate the remaining voltage (S322). After that, the charge bias application circuit 206 applies the charge bias (PWM(3)) determined in S320 to the photosensitive drum 201 (S323), and emits laser of a laser light amount value PWM(6) onto the photosensitive drum 201 to set the voltage on the photosensitive drum 201 to VL (S324). Subsequently, the charge bias application circuit 301 applies a DC negative bias (PWM(5)), which is a predetermined DC voltage, to the photosensitive drum 201 (S325). Then, the engine control part 502 detects, by using the current detection circuit part 305, the current I63 obtained by summing the current I62 flowing from the photosensitive drum 201 and the current I61 flowing from the feedback circuit part 306, to thereby detect the analog value of J301 (S326). The engine control part 502 calculates the charge current from the detection value (S327). Then, the engine control part 502 compares the calculation value and the Δ value to determine whether or not the calculation value falls within the tolerance of the Δ value (S328). When it is determined that the calculation value is larger than the upper limit of the Δ value, the engine control part 502 determines that the VL value is set to a lower value, and hence causes the control circuit part 351 of the laser driving circuit 505 to step down the laser light amount value (PWM(6)), to thereby decrease the light amount (S329). On the other hand, when it is determined that the calculation value is smaller than the lower limit of the Δ value, the engine control part 502 determines that the VL value is set to a higher value, and hence causes the control circuit part 351 to step up the laser light amount setting value (PWM(6)), to thereby increase the light amount (S330). Through this control, the engine control part 502 determines that, when the calculation value falls within the tolerance of the Δ value, the laser light amount value (PWM(6)) at this time is the predetermined laser light amount, and causes the control circuit part 351 to set the laser light amount value (PWM(6)) (S331). Through this sequence, the voltage between VL−Vdc is controlled to be a predetermined value as shown in FIG. 7C. After those settings are completed, the printing is started. Through the control described above, a stabilized voltage as shown in FIG. 7D is obtained irrespective of the condition of the circumstance or the drum layer thickness, with the result that a high-quality image can be realized.

With the image forming apparatus of this embodiment, a high-quality image can be obtained irrespective of a change in circumstance or drum layer thickness.

Next, a second embodiment of the present invention is described.

Similarly to the first embodiment, the second embodiment utilizes the characteristic that the voltage difference necessary to start the charging is symmetric between the positive voltage and the negative voltage with respect to the zero drum voltage (positive-negative symmetry). However, the image forming apparatus of this embodiment is different from that of the first embodiment in that the laser light amount variable function is not provided. Accordingly, the image forming apparatus of this embodiment can be made more inexpensive than that of the first embodiment.

Charge Bias Control

Figures 8, 8A, 8B:
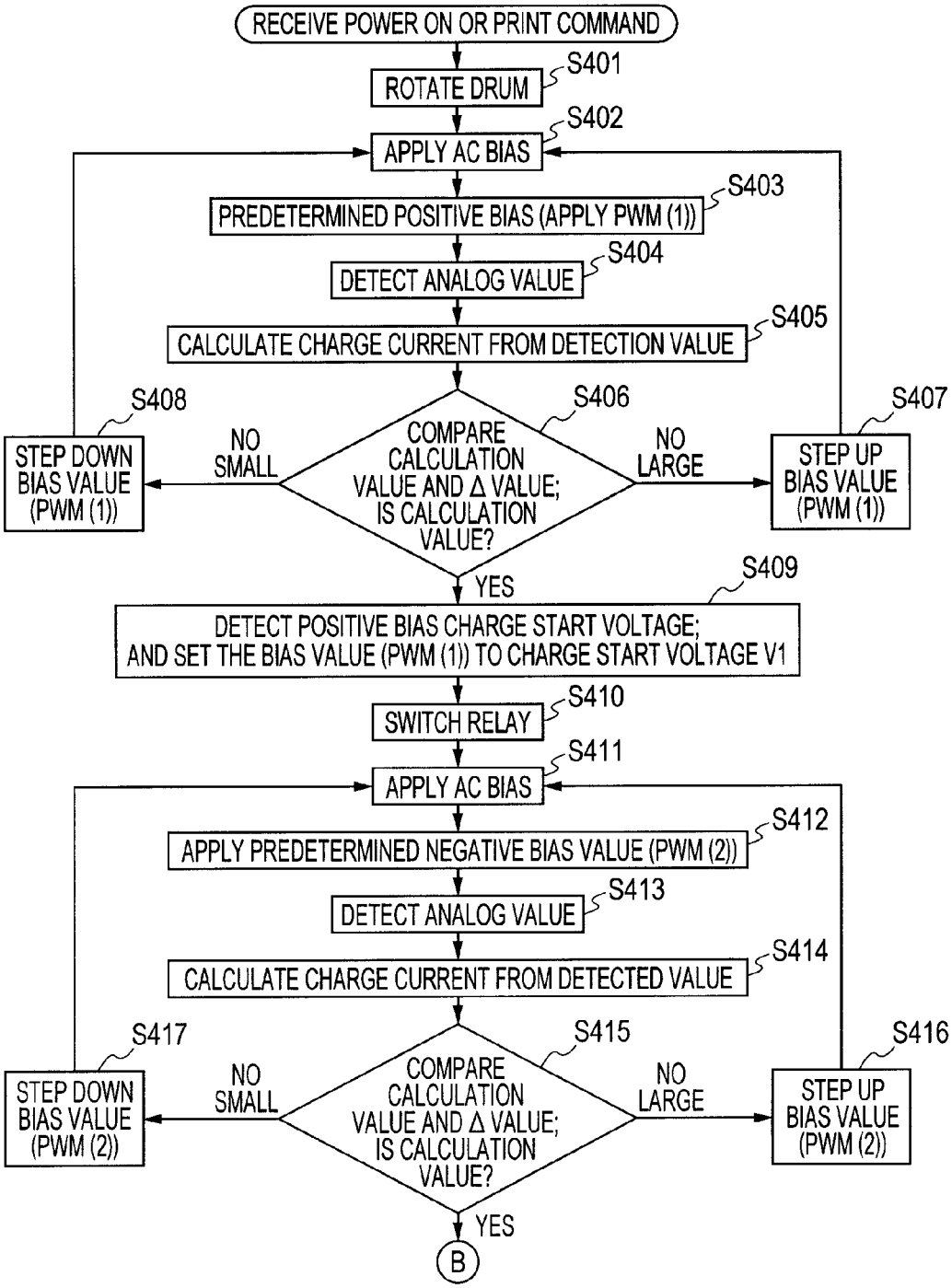
FIG. 8 is comprised of FIGS. 8A and 8B showing flowcharts illustrating charge bias control according to a second embodiment of the present invention.
Figure 8B:
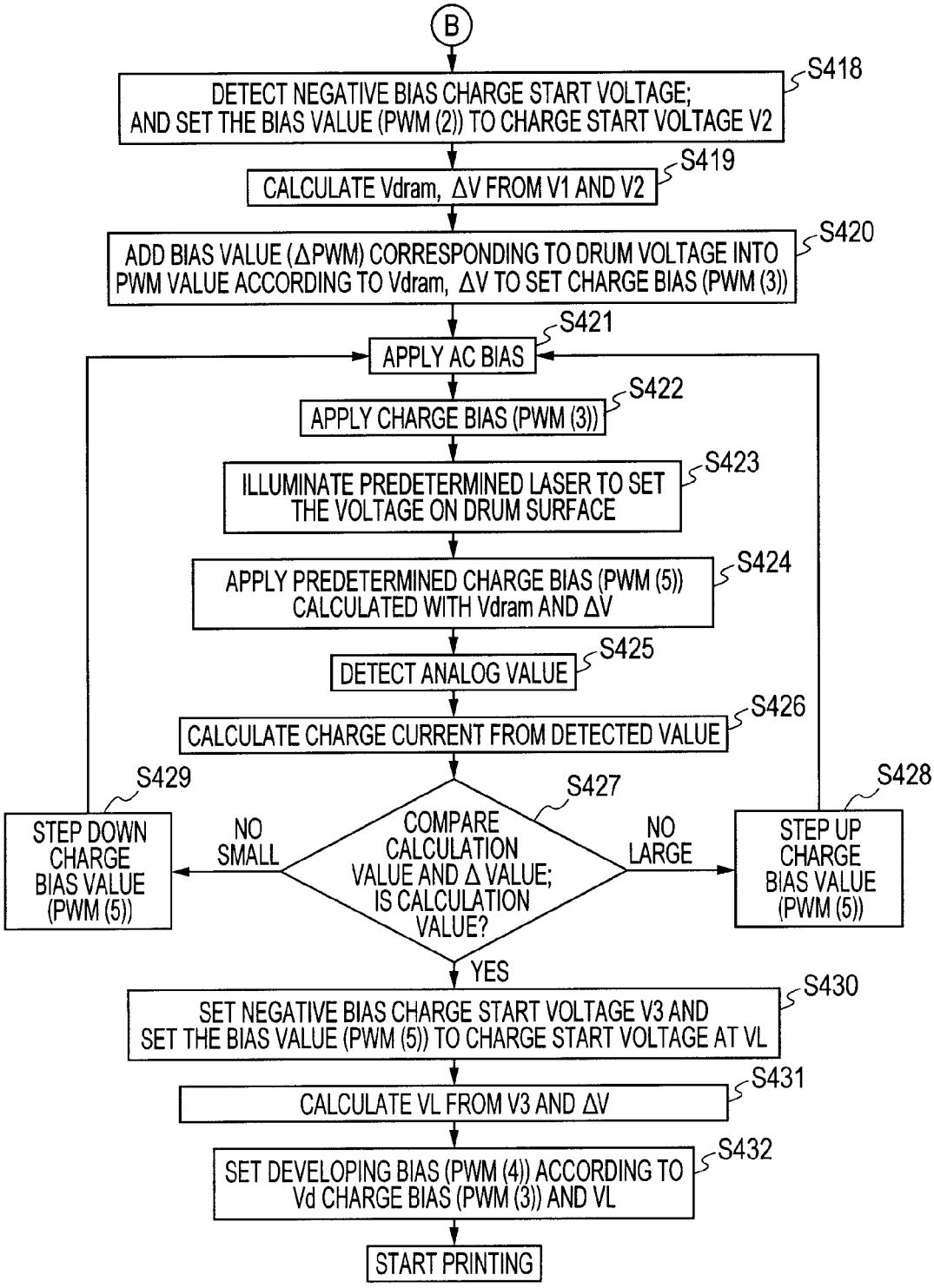

The configurations of the image forming apparatus and the charge bias application circuit according to this embodiment are the same as those of the first embodiment, and description thereof is therefore omitted herein. Next, referring to flowcharts of FIGS. 8A and 8B and voltage graphs of FIGS. 9A to 9C, the control of this embodiment is described. The process of from S5401 to S420 of FIGS. 8A and 8B is the same as the process of from S301 to S320 of FIGS. 6A and 6B according to the first embodiment, and description thereof is therefore omitted herein.

Figure 9A:
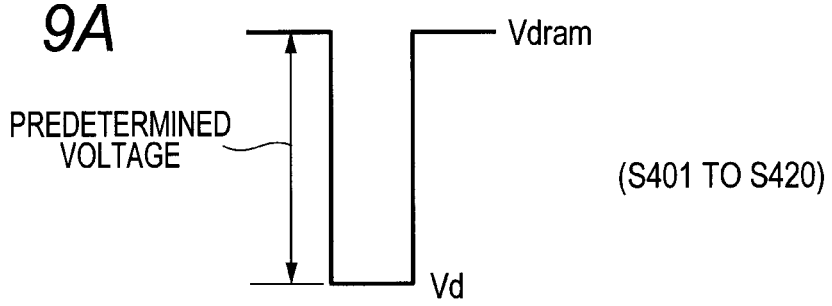
FIGS. 9A, 9B, and 9C are graphs showing voltages of the photosensitive drum obtained as a result of the charge bias control according to the second embodiment.

The setting value of the charge bias (PWM(3)) to be output from the charge bias application circuit 206 is ΔV+Vdram+Vd, provided that Vd represents a voltage to be superposed onto the photosensitive drum 201. With this set voltage, the voltage Vd becomes constant as shown in FIG. 9A.

Figure 9B:
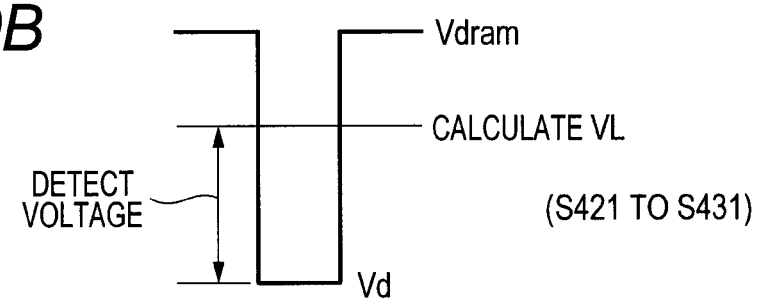
Figure 9C:
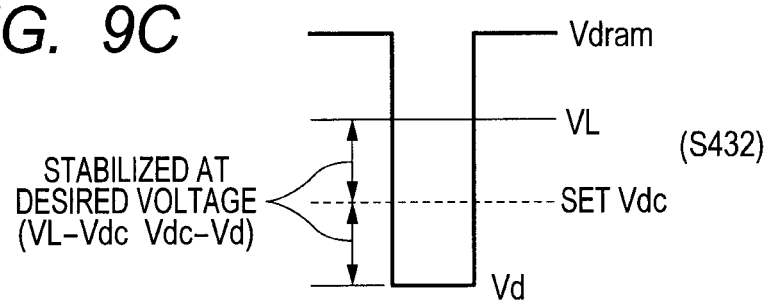

Subsequently, the process proceeds to a sequence of detecting the voltage VL after the laser illumination. First, the charge bias application circuit 206 applies the AC bias to the photosensitive drum 201 to eliminate the remaining voltage on the photosensitive drum 201 (S421). After that, the charge bias application circuit 206 applies the charge bias (PWM(3)) determined in S420 to the photosensitive drum 201 (S422), and emits laser onto the photosensitive drum 201 to set the voltage on the photosensitive drum 201 to VL after the laser illumination (S423). Subsequently, the charge bias application circuit 301 applies a predetermined DC negative bias (PWM(5)) (S424). Then, the engine control part 502 detects, by using the current detection circuit part 305, the current I63 obtained by summing the current I62 flowing from the charge member and the current I61 flowing from the feedback circuit part 306, to thereby detect the analog value of J301 (S425). The engine control part 502 calculates the charge current from the detection value (S426). Then, the engine control part 502 compares the calculation value and the Δ value to determine whether or not the calculation value falls within the tolerance of the Δ value (S427). When it is determined that the calculation value is larger than the upper limit of the Δ value, the engine control part 502 determines that the charge start voltage is set to a lower value, and hence steps up the bias value (PWM(5)) (S428). On the other hand, when the determination result shows that the calculation value is smaller than the lower limit of the Δ value, the engine control part 502 determines that the charge start voltage is set to a higher value, and hence so as to step down the bias value (PWM(5)) (S429). Through this operation, when the calculation value falls within the tolerance of the Δ value, the engine control part 502 sets the bias value (PWM(5)) at this time as a charge start voltage V3 of the negative bias (S430). From the charge start voltage V3 at VL and the voltage difference ΔV necessary to start the charging obtained through the above-mentioned sequence, the engine control part 502 calculates VL by an expression of V3−ΔV=VL (S431). In this manner, the voltage between VL−Vd can be detected as shown in FIG. 9B.

Then, according to the values of Vd and VL that are set and calculated through the above-mentioned sequence, the engine control part 502 sets the developing bias (PWM(4)) (S432). When setting the developing bias (PWM(4)), it is considered that the value of the voltage between VL−Vdc, which may affect the contrast, falls within the predetermined range. Through the control described above, a predetermined voltage as shown in FIG. 9C is obtained irrespective of the condition of the circumstance or the drum layer thickness, with the result that a high-quality image can be realized.

With the image forming apparatus of this embodiment, a high-quality image can be obtained irrespective of a change in circumstance or drum layer thickness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-149375, filed Jun. 30, 2010, which is hereby incorporated by reference herein in its entirety.

What is claimed is:

1. An image forming apparatus, comprising:

an image bearing member;

a first voltage application section for applying a first DC voltage to a charge section for charging the image bearing member;

a second voltage application section for applying a second DC voltage, which has a polarity reverse to a polarity of the first DC voltage, to the charge section for charging the image bearing member; and a calculation section for calculating a surface voltage of the image bearing member based on a first charge start voltage between the charge section and the image bearing member, which is obtained when the first voltage application section applies the first DC voltage to the charge section, and a second charge start voltage between the charge section and the image bearing member, which is obtained when the second voltage application section applies the second DC voltage to the charge section.

2. An image forming apparatus according to claim 1, further comprising:

a first current detection section for detecting a first current value of a current flowing through the image bearing member when the first voltage application section applies the first DC voltage to the charge section; and a second current detection section for detecting a second current value of a current flowing through the image bearing member when the second voltage application section applies the second DC voltage to the charge section, wherein the calculation section is configured to set a DC voltage obtained in a case where the first current value detected by the first current detection section has reached to a predetermined value when the first voltage application section applies the first DC voltage to the charge section, as the first charge start voltage, set a DC voltage obtained in a case where the second current value detected by the second current detection section has reached to a predetermined value when the second voltage application section applies the second DC voltage to the charge section, as the second charge start voltage, and calculate the surface voltage of the image bearing member by using a value obtained by halving a difference between the first charge start voltage and the second charge start voltage.

3. An image forming apparatus according to claim 1, wherein the first DC voltage comprises a voltage in a positive polarity and the second DC voltage comprises a voltage in a negative polarity.

4. An image forming apparatus according to claim 1, further comprising an exposure section for exposing the image bearing member to light to form a latent image on the image bearing member, wherein the calculation section calculates a voltage of the image bearing member in a state in which the image bearing member is not charged by the charge section, and a voltage of the image bearing member in a state in which the image bearing member is exposed to the light by the exposure section after the image bearing member is charged by the charge section, based on a value obtained by halving a difference between the first charge start voltage and the second charge start voltage.

5. An image forming apparatus according to claim 4, further comprising a developing section for developing the latent image formed on the image bearing member by the exposure section, wherein a voltage to be applied to the charge section, a voltage to be applied to the developing section, and a light amount in which the exposure section emits light onto the image bearing member are set according to the surface voltage obtained by the calculation section.

6. An image forming apparatus according to claim 4, further comprising a developing section for developing the latent image formed on the image bearing member by the exposure section, wherein a voltage to be applied to the charge section and a voltage to be applied to the developing section are set according to the surface voltage obtained by the calculation section.

* * * * *